US005497678A

United States Patent [19]

Chou

[11] Patent Number: 5,497,678

[45] Date of Patent: Mar. 12, 1996

[54] ADJUSTABLE ADAPTOR ATTACHMENT FOR THE ACCELERATOR PEDAL OF A MANUAL TRANSMISSION VEHICLE USED IN COMPETITIVE DRIVING

[76] Inventor: Wayne W. Chou, 25 Hauley Pl., Ridgefield, Conn. 06877

[21] Appl. No.: 287,676

[22] Filed: Aug. 9, 1994

[51] Int. Cl.[6] ..... G05G 1/16

[52] U.S. Cl. ..... 74/562.5; 74/562

[58] Field of Search ..... 74/513, 562, 562.5, 74/563; 477/209, 210, 215

[56] References Cited

U.S. PATENT DOCUMENTS

| | | | |
|---|---|---|---|
| 1,595,467 | 8/1926 | Hart | 74/562.5 |
| 2,078,324 | 4/1937 | Griffiths | 74/562.5 |
| 2,088,182 | 7/1937 | Verch | 74/513 X |
| 2,123,299 | 7/1938 | Gibbons, Jr. et al. | 74/513 |
| 2,521,606 | 9/1950 | Rodd | 74/513 |
| 2,553,080 | 5/1951 | Ching, Sr. | 477/215 |
| 2,722,847 | 11/1955 | Petrochko | 74/562.5 X |
| 3,361,006 | 1/1968 | Smith | 74/513 X |
| 3,543,606 | 12/1970 | Kaul | 74/562.5 |
| 3,626,785 | 12/1971 | Ross | 74/562 X |
| 4,802,381 | 2/1989 | Hsin-hsin | 74/513 |

*Primary Examiner*—Rodney H. Bonck
*Assistant Examiner*—Mary Ann Battista
*Attorney, Agent, or Firm*—Parmele, Bollinger & Bramblett

[57] ABSTRACT

An adaptor having a base plate adapted to fit on an accelerator pedal of a vehicle has an operating plate with upper and lower portions thereon. The operating plate is elevationally and adjustably mounted on the base plate. A lateral integral projection extends outwardly from the lower portion of the operating plate. The adaptor is removably attached to the accelerator pedal which facilitates the positioning of the toe and heel of the same foot of the user on the operating plate for controlling the braking and acceleration of the vehicle without lifting or moving the foot from one pedal to the other. The use of the adaptor permits a conventional manual transmission vehicle to be converted for stock car racing. In an alternative embodiment, the accelerator pedal per se replaces the base and the adaptor is directly attached to the accelerator pedal.

8 Claims, 3 Drawing Sheets

ADJUSTABLE ADAPTOR ATTACHMENT FOR THE ACCELERATOR PEDAL OF A MANUAL TRANSMISSION VEHICLE USED IN COMPETITIVE DRIVING

BACKGROUND OF THE INVENTION

This invention relates to an adaptor for converting a conventional touring vehicle into a vehicle for competitive driving and more particularly to an adaptor for an accelerator pedal of a vehicle which varies the height and pitch and roll of the accelerator pedal with respect to the brake pedal to facilitate toe and heel control of the vehicle.

Production line vehicles provide a brake pedal with certain height and separation from the gas or accelerator pedal. In normal driving conditions the right foot of the vehicle operator normally rests on the accelerator pedal and is lifted therefrom and applied to the brake pedal for slowing or stopping the vehicle. In competitive driving a toe and heel operation with the right foot is employed as speed is the object. Normally the vehicle must be downshifted before hitting a corner or a sharp curve. On downshifting, an increase in the engine speed is desirable to match the speed of the downshift and provide a smooth transition from a fast to a slower speed when hitting the corners. Speed is then increased rapidly when coming out of the corners. This is normally done with a toe and heel control in which the driver brakes with the toe and rotates with the heel on the accelerator pedal to increase engine speed while downshifting so as to provide the desired match of engine speed to road speed when the clutch is released. In order to provide the toe and heel control, the elevation as well as the pitch and roll inclination of the accelerator pedal must be altered to accommodate the particular driver. This is desired to be done without changing the manufacturing processes in assembling the original vehicle. In other words, it would be extremely expensive to customize the height and separation of the brake and accelerator pedals of different production models to accommodate a toe and heel control by different drivers. At the same time, such changes would not be desirable or necessary for normal street or highway driving.

SUMMARY OF THE INVENTION

Accordingly, it is an object of this invention to provide a new and improved adaptor for a manual transmission vehicle which may be applied to normal production models of vehicles without modifying the spacing or positioning of the brake and accelerator pedals of a motor vehicle.

Another object of this invention is to provide a new and improved adaptor for a manual transmission vehicle which readily permits converting a normal touring vehicle into a vehicle suitable for competitive driving such as stock cars.

Still another object of this invention is to provide a new and improved adaptor for a manual transmission vehicle which is readily mountable and removable from the accelerator pedal of a vehicle and which can readily adapt the elevation and pitch and roll of the accelerator pedal with respect to the brake pedal of a vehicle in order to provide convenient heel and toe control of the brake and accelerator pedals using the same foot.

In carrying out this invention in one illustrative embodiment thereof, an adaptor is provided for a manual transmission vehicle having brake and accelerator pedals with the adaptor being adapted to be positioned on the accelerator pedal. The adaptor has a base plate adapted to fit on an accelerator pedal of a vehicle and an operating plate thereon which operating plate is elevationally and adjustably mounted on the base plate. An integral lateral projection extends outwardly from the operating plate and below the brake pedal of the vehicle on which the adaptor is mounted for facilitating the position of the heel of the user thereon while the toe rests on the brake pedal whereby the toe and heel of the same foot of the user may control the braking and acceleration of the vehicle without lifting or moving the foot from one pedal to the other. The adaptor is removably attached to an accelerator pedal of the vehicle or may incorporate the accelerator pedal.

DESCRIPTION OF THE DRAWINGS

The invention, together with further objects, aspects, advantages and features thereof will be more clearly understood from the following description taken in connection with the accompanying drawings.

DESCRIPTION OF THE PREFERRED EMBODIMENTS

Figure 1:
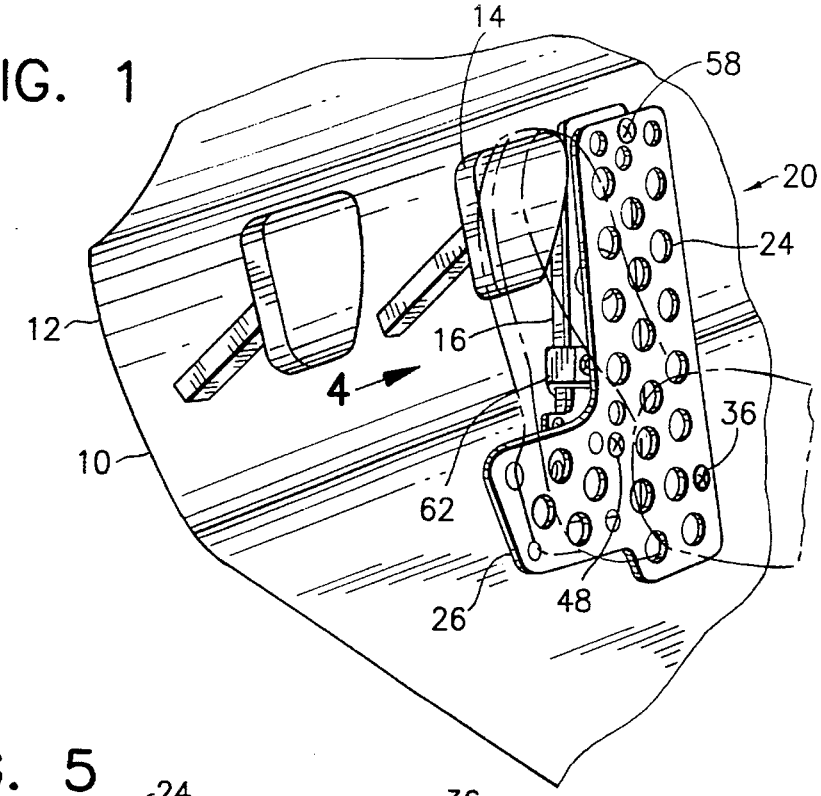
FIG. 1 is an asynmetric view of a portion of the driver's side floor board illustrating the adaptor in accordance with the present invention mounted in the vehicle's accelerator pedal and demonstrating the position of the driver's foot in phantom.

Referring now to FIG. 1, a driver's side floor board 10 has a clutch pedal 12, a brake pedal 14, and a gas or accelerator pedal 16. The clutch 12 is provided for a car having a manual transmission. In conventional vehicles, the accelerator pedal 16 is mounted to the right of the brake pedal 14. In normal driving, the driver's right foot rests on the gas or accelerator pedal 16 and is lifted off the gas pedal upward to the brake pedal for stopping the car or slowing it up. This arrangement is not suitable for operating the vehicle in competitive driving. In competitive driving, it is necessary to facilitate up and downshifting in the least time possible. When utilizing the heel and toe technique, the toe of the user rests on the brake pedal and the heel of the same foot of the user rests on the accelerator pedal which is difficult and impractical unless the brake pedal 14 and the accelerator pedal 16 are modified in both spacing and elevation.

Figure 4:
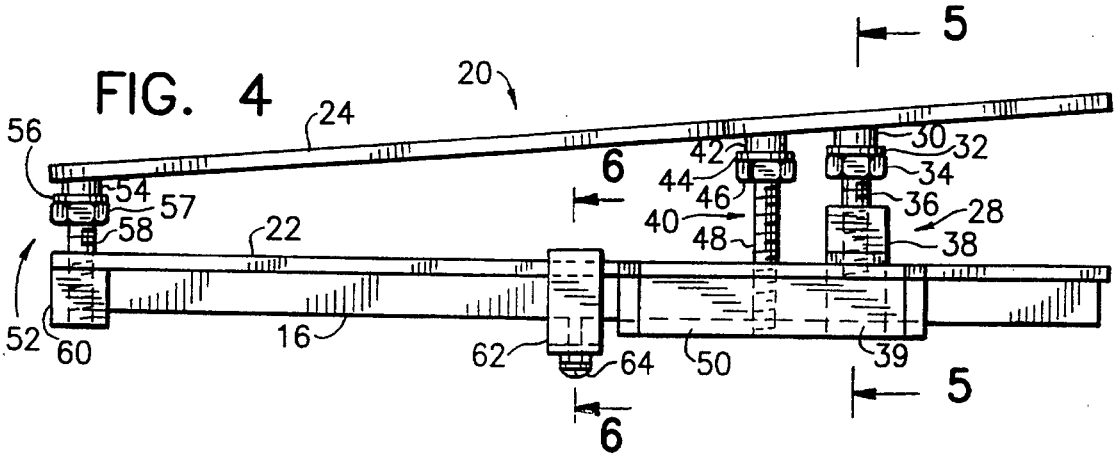
FIG. 4 is a side elevational view of the adaptor shown in FIG. 1 and being viewed in the direction of the arrow.
Figure 2:
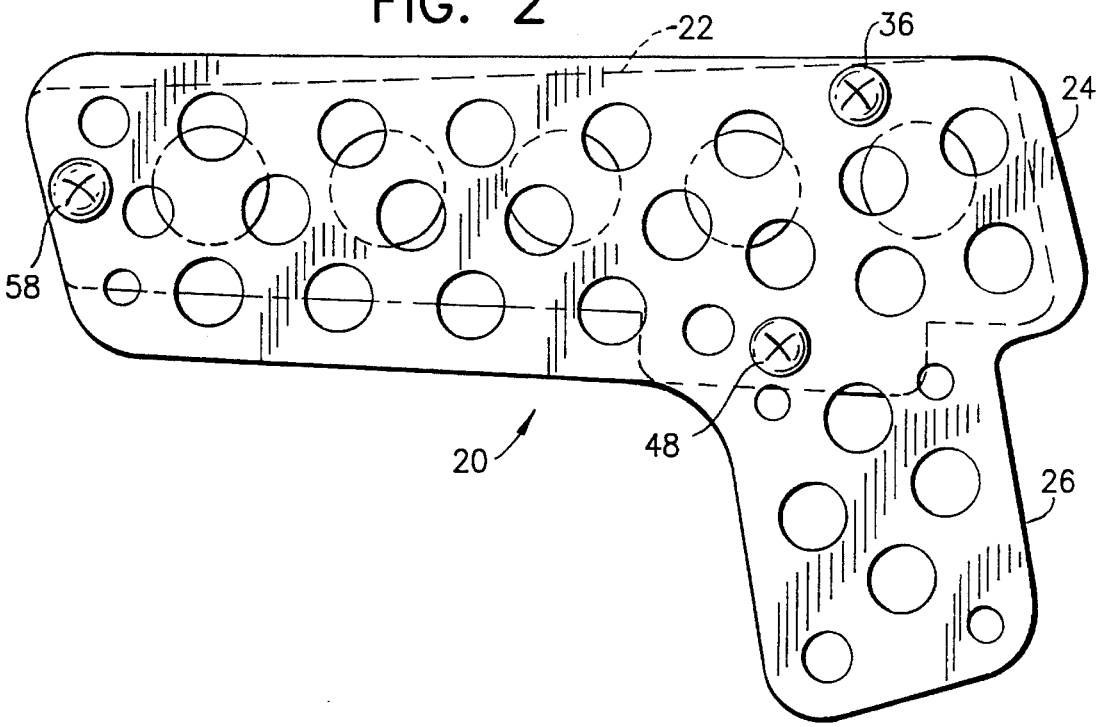
FIG. 2 is a top view of the adaptor of the present invention.
Figure 3:
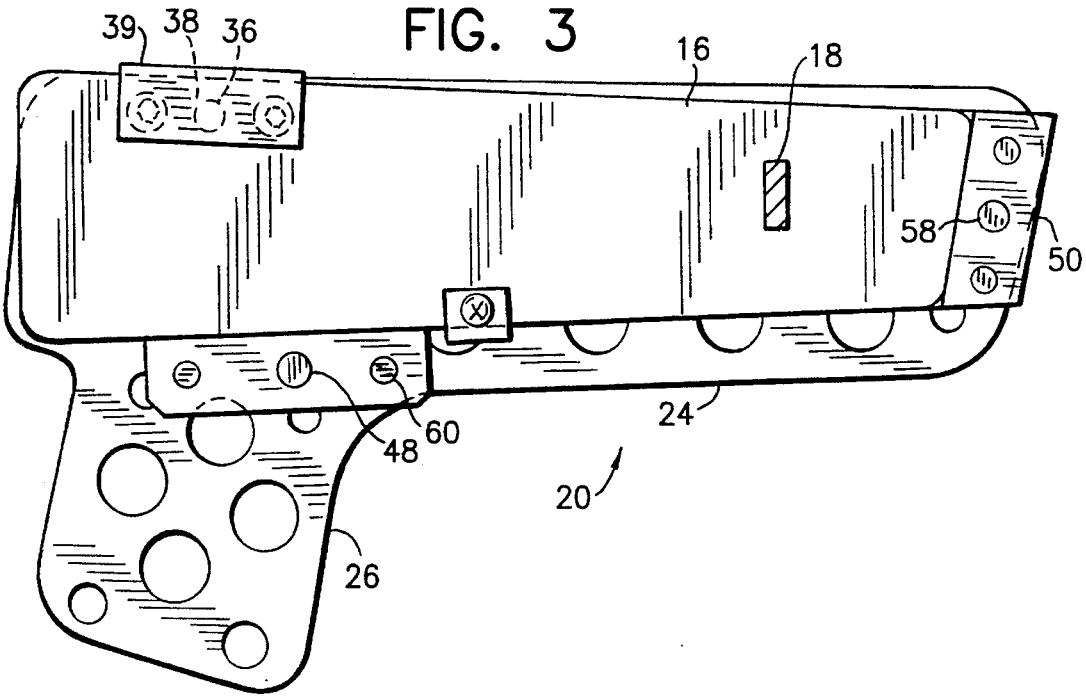
FIG. 3 is a bottom view of the adaptor shown in FIG. 2.

In accordance with an embodiment of the present invention, an adaptor 20 is removably mounted on the accelerator pedal 16 by a U-shaped clamp 62 as shown in FIG. 1. The adaptor 20 of a first embodiment is best seen in FIGS. 2, 3 and 4 and comprises a base plate 22 and an operating plate 24. The operating plate has an integral lateral projection 26 thereon which is useful in accommodating the heel of the user as is illustrated in phantom in FIG. 1.

The adaptor 20 (as best seen in FIG. 4) has the operating plate 24 mounted on the base plate 22 by a plurality of adjustable mounting means 28, 40 and 52. Adjustable means 28 comprises an elastic bushing 30, a washer 32, a nut 34, a machine screw 36 and a threaded socket 38. The adjustable mounting means 40 comprises an elastic bushing 42, a washer 44, a nut 46, for mounting a machine screw 48 in a threaded socket 50. The adjustable mounting means 52 comprises an elastic bushing 54, a washer 56 and a nut 57 for mounting a machine screw 58 in a threaded socket 60. As will be best be seen in FIG. 2, the machine screw 58 is positioned on the upper portion of the operating plate 24 when it is mounted on an accelerator pedal 16 while the adjustable machine screws 36 and 48 are spaced apart and mounted in the lower portion of the operating plate when it is positioned on the accelerator pedal 16.

With respect to the adjustable mounting means, the functioning of adjustable mounting means 40 which is explained hereafter is the same as adjustable mounting means 28 and 52. Machine screw 48 rotates freely in a clearance hole provided for in operating plate 24. Operating plate 24 is trapped between the head of screw 48 and the assembly of the elastic bushing 42, washer 44 and nut 46. Nut 46 is tightened to compress bushing 42 to limit the freedom of movement and to add friction to prevent vibration from altering the adjustment provided by the adjustable mounting means 40. This allows limited angular movement between the operating plate 24 and the base plate 22.

Figure 7:
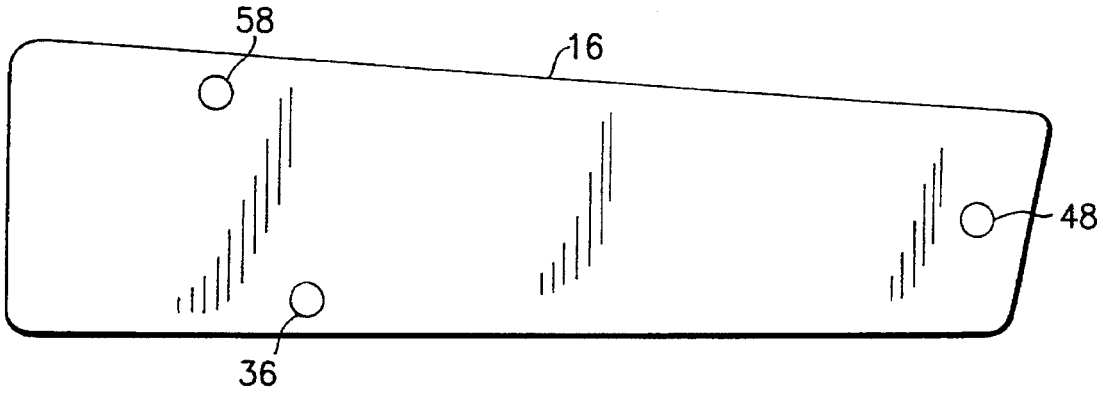
FIG. 7 is a top view of an accelerator pedal having sockets for adaptor incorporated therein.

As will best be seen in FIG. 3, the threaded sockets 38, 50 and 60 which carry the machine screws 36, 48 and 58, respectively are mounted by any suitable means such as rivets, screws, welding, etc. to the base plate 22 and are spaced thereon such that threaded sockets 50 and 60 border and are contiguous to the accelerator pedal 16 as illustrated while the block 38 has a U-shaped flange 39 thereon which cradles the accelerator pedal therein when the adaptor is positioned on the accelerator pedal 16 which has an accelerator link 18 coupled thereto as shown in FIG. 3. Accordingly, the threaded sockets 38, 50 and 60 are used to properly position the adaptor 20 in a very rapid and simple manner on the accelerator pedal so the adaptor 20 can be attached thereto. In another embodiment (FIG. 7), the accelerator pedal 16 is modified to carry the sockets 38, 50 and 60, thereby dispensing with the base plate 22 and clamp 62.

Figure 5:
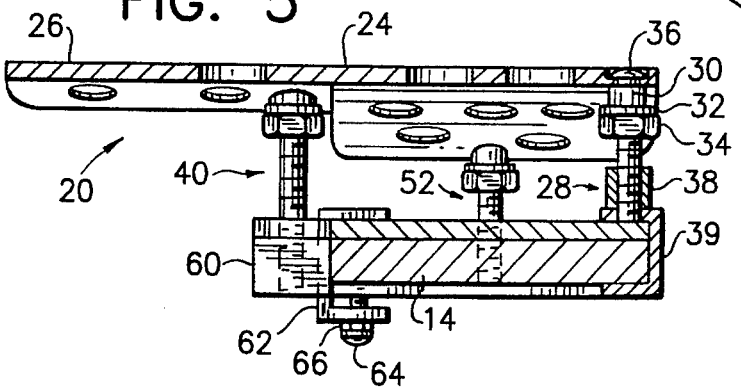
FIG. 5 is a cross sectional view taken along line 5—5 of FIG. 4.
Figure 6:
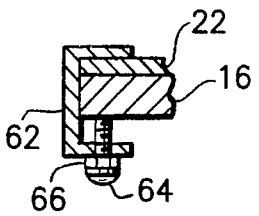
FIG. 6 is a cross sectional view taken along line 6—6 of FIG. 4.

The attachment means as is best seen in FIGS. 4–6 comprises a U-shaped clamp 62 carrying a clamp screw 64 and a nut 66. The clamp is to be positioned with the screw on top to facilitate use on the pedal 16. When the adaptor 20 is desired to be used for converting a touring vehicle to a stock car racer, the adaptor 20 is simply positioned on the accelerator pedal using the sockets 38, 50 and 60 as a guide which actually cradle the pedal 16 under the base plate 22. The U-shaped clamp 62 is slipped over the operating plate and accelerator pedal, the screw 64 tightened thereby clamping the adaptor 20 onto to the accelerator pedal 16. As previously pointed out, by incorporating the sockets in the accelerator pedal, the base plate 22 and U-shaped clamp 62 would not be required.

The adjustable mounting means 28, 40 and 52 provide adjustments in elevation and pitch and roll to accommodate the requirements of different drivers. The adjustable means controls the height as well as the pitch and roll of the adaptor which will accommodate different drivers as well as the nuances of different models made by different automobile manufacturers. The lateral projection 26 when mounted as shown in FIG. 1 extends below the brake pedal 14 and is adjustably elevated as is best seen in FIG. 4. This particular construction accommodates the heel of the user as shown in FIG. 1 and facilitates the toe and heel control of the brake and accelerator pedal, respectively whereby the toe is used to brake and the rotation of the heel is used for acceleration. The fine adjustments of pitch and roll and elevation can be customized using the adaptor 20 in accordance with the desire of the user.

The Swiss cheese configuration of the base and operating plates of the adaptor 20 are provided to lighten the mass of the adaptor. This is not an essential requirement and will depend on the application as well as the materials which are employed in constructing the adaptor.

Accordingly, an adaptor has been provided to convert a touring vehicle to a stock car vehicle suitable for competitive driving or to convert a stock car from a track to a street vehicle in a matter of minutes. The use of the adaptor does not require structural modifications of a vehicle in order to accommodate toe/heel control of a single foot for providing the operations described. Furthermore, the adaptor may be utilized for different models and for models of different manufacturers without altering the structural features of the vehicle in order that the vehicles may be operated as described herein. The only structural change in one alternative embodiment would be the incorporation of the sockets directly in the accelerator pedal.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. An adaptor attachment for a manual transmission vehicle having brake and accelerator pedals, said adaptor attachment adapted to be positioned on the accelerator pedal for permitting control of braking and acceleration using the toe and heel of the same foot, respectively, said adaptor attachment comprising:

a base plate adapted to fit on the accelerator pedal of the vehicle, an operating plate, adjustable mounting means for mounting said operating plate on said base plate to adjustably vary the position of said operating plate with respect to said base plate in elevation, pitch and roll, said adjustable mounting means being independently adjustable to a plurality of different adjustment positions for capturing and retaining each of said plurality of different adjustment positions, an integral lateral protection extending outwardly from said operating plate and adapted to extend below the brake pedal of the vehicle on which the adaptor attachment is mounted for facilitating the positioning of the heel of the user thereon while the toe rests on the brake pedal whereby the toe and heel of the same foot of the user may control the braking and acceleration of the vehicle without lifting or moving the foot from one said pedal to the other, and attachment means for removably attaching said adaptor attachment to the accelerator pedal.

2. The adaptor attachment as claimed in claim 1 wherein said adjustable mounting means includes a plurality of machine screws and threaded sockets spaced around said operating plate.

3. The adaptor attachment as claimed in claim 1 wherein said attachment means comprises a screw operated clamp having a screw mounted in said clamp whereby said clamp is placed on said base plate and said clamp is adapted to secure the base plate to the accelerator pedal by tightening said screw in said clamp.

4. An adaptor attachment for a manual transmission vehicle having brake and accelerator pedals, said adaptor attachment adapted to be positioned on the accelerator pedal of the vehicle for permitting control of braking and acceleration using the toe and heel of the same foot, respectively, said adaptor attachment comprising:

a base plate adapted to fit on the accelerator pedal of the vehicle on which the adaptor attachment is to be used, an operating plate, an integral, lateral projection extending outwardly from said operating plate and adapted to extend below the brake pedal of the vehicle on which the adaptor attachment is mounted, plurality of adjustable means for adjustably mounting said operating plate on said base plate in elevation, pitch and roll with respect to said base plate, each of said plurality of adjustable means including a machine screw and a threaded socket which are separated and spaced from each other cn said operating plate for controlling the separation between said operating and base plates and the pitch and roll orientation of said operating plate with respect to said base plate whereby when said adaptor attachment is positioned on said accelerator pedal, the adaptor attachment will accommodate toe and heel control of said brake and acceleration pedals without modifying the vehicle brake and acceleration pedals, and attachment means compri. sing a screw operated clamp having a screw mounted in said clamp, wherein said clamp is placed on said base plate and said clamp is adapted to clamp the base plate to the accelerator pedal by tightening said screw in said clamp.

5. An adaptor for a manual transmission vehicle having brake and accelerator pedals, said adaptor adapted to be mounted on said accelerator pedal for permitting the toe and heel of the same foot to control braking and acceleration, respectively, said adaptor comprising:

an operating plate, a plurality of mounting means spaced on said operating plate for mounting said operating plate on the accelerator pedal, a plurality of adjustable means for said plurality of mounting means, each of said plurality of adjustable means being independently adjustable to a plurality of different adjustment positions for capturing and retaining each of said plurality of different adjustment positions for varying the height, pitch and roll of said operating plate with respect to said accelerator pedal for facilitating the positioning of the toe and heel of the same foot of the user on said brake pedal and said operating plate whereby toe and heel control of the braking and acceleration of the vehicle is facilitated.

6. The adaptor as claimed in claim 5, having a base plate, said plurality of mounting means mounting said operating plate on said base plate, and means for removably mounting said adaptor on said acceleratcr pedal.

7. The adaptor as claimed in claim 5 wherein said plurality of mounting means includes a plurality of threaded sockets positioned in said accelerator pedal.

8. The adaptor as claimed in claim 5, wherein said operating plate has an integral lateral projection adapted to extend outwardly therefrom and extending below the brake pedal of the vehicle on which the adaptor is mounted for facilitating the positioning of the heel of the user thereon while the toe rests on the brake pedal.

* * * * *